United States Patent [19]

Becker et al.

[11] Patent Number: 5,044,552

[45] Date of Patent: Sep. 3, 1991

[54] SUPERSONIC COAL WATER SLURRY FUEL ATOMIZER

[75] Inventors: Frederick E. Becker, Reading; Leo A. Smolensky, Concord; John Balsavich, Foxborough, all of Mass.

[73] Assignee: The United States of America as represented by the United States Department of Energy, Washington, D.C.

[21] Appl. No.: 430,032

[22] Filed: Nov. 1, 1989

[51] Int. Cl.[5] ..... B05B 7/06; B05B 17/04

[52] U.S. Cl. ..... 239/8; 239/424

[58] Field of Search ..... 239/8, 424; 110/265; 431/2, 8, 187, 188, 354

[56] References Cited

U.S. PATENT DOCUMENTS

| | | | |
|---|---|---|---|
| 1,793,897 | 2/1931 | Barnes . | |
| 2,290,295 | 7/1942 | Scheller . | |
| 3,266,552 | 8/1966 | Denis | 431/8 |
| 3,565,593 | 2/1971 | Moore, Jr. . | |
| 3,650,475 | 3/1972 | Stubblefield et al. . | |
| 4,171,091 | 10/1979 | van Hardeveld et al. . | |
| 4,525,138 | 6/1985 | Snyder et al. . | |
| 4,559,009 | 12/1985 | Marino et al. | 431/187 |
| 4,634,054 | 1/1987 | Grusha . | |
| 4,634,611 | 1/1987 | Browning . | |
| 4,726,760 | 2/1988 | Skoog | 110/265. |
| 4,762,532 | 8/1988 | Lipp . | |
| 4,838,185 | 6/1989 | Flament | 110/265 |

FOREIGN PATENT DOCUMENTS

| | | | |
|---|---|---|---|
| 3604304 | 8/1987 | Fed. Rep. of Germany | 239/424 |
| 56-108624 | 8/1981 | Japan . | |

OTHER PUBLICATIONS

"The Dynamics and Thermodynamics of Compressible Fluid Flow" by Shapiro Wiley Inc., 1953, pp. 73-155.

*Primary Examiner*—Andres Kashnikow
*Assistant Examiner*—Michael J. Forman
*Attorney, Agent, or Firm*—Helen S. Cordell; John M. Albrecht; William R. Moser

[57] ABSTRACT

A supersonic coal water slurry atomizer utilizing supersonic gas velocities to atomize coal water slurry is provided wherein atomization occurs externally of the atomizer. The atomizer has a central tube defining a coal water slurry passageway surrounded by an annular sleeve defining an annular passageway for gas. A converging/diverging section is provided for accelerating gas in the annular passageway to supersonic velocities.

17 Claims, 3 Drawing Sheets

SUPERSONIC COAL WATER SLURRY FUEL ATOMIZER

The government has rights in this invention pursuant to contract number DE-AC22-87PC79650 awarded by the U.S. Department of Energy.

BACKGROUND OF THE INVENTION

The present invention relates generally to fuel atomizers and more particularly to a supersonic coal water slurry fuel atomizer.

Twin fuel atomizers are designed to break up a stream of liquid by contacting it with gas or steam traveling at a high velocity. The degree of break up of the liquid is achieved through the type of nozzle utilized for atomization. It is important that the characteristics of the nozzle remain constant in order to provide a constant degree of atomization. However, the liquid which is being atomized may be abrasive which ultimately leads to erosion of the nozzle and deterioration of the nozzle's properties.

Nozzles for atomizing fuel are utilized in various fields for various purposes. The twin fluid atomizer may comprise a liquid supply tube surrounded by a coaxial gas supply tube. Traditional twin fluid atomizers are subject to erosion. Erosion is especially apparent in twin fluid atomizers which atomize coal water slurry.

Coal water slurries generally comprise a liquid carrier and a solid carbonaceous fuel. The coal water slurry is highly abrasive due to the presence of the solid carbonaceous fuel. In the traditional twin fluid atomizers, high velocities of the coal water slurry are necessary for atomization which leads to severe erosion of exposed portions of the atomizer. Such erosion ultimately destroys the properties of the atomizer.

Erosion is not the only problem encountered with traditional twin fluid atomizers. Another problem with traditional twin fluid atomizers is that the secondary fluid used to atomize the coal water slurry is typically compressed air or steam at pressures between 50 to 100 psi or greater. A high pressure pump is required to inject the coal water slurry at a pressure above the pressure of the secondary fluid. High pressure pumps are expensive and can subject the coal water slurry to a high degree of shear and thereby degrade shear sensitive slurries before they enter the atomizer. Degradation of the slurries is not desirable.

U.S. Pat. No. 4,171,091 discloses a twin fuel sprayer comprising a liquid supply tube surrounded by a coaxial gas or gas mixture supply tube. Since the device mixes fuel inside the sprayer, the sprayer is subjected to erosion.

U.S. Pat. No. 4,762,532 also discloses a twin-fluid nozzle which may combine a carbonaceous slurry and a gas. The nozzle is made adjustable so as to provide a substantially constant mixing energy.

Other devices are known for achieving atomization. Although these devices have their advantages, they suffer from a number of problems such as erosion within the nozzle, plugging of the nozzle, the need for high pressure pumps, etc.

There continues to be a need for coal water slurry atomizers which overcome the shortcomings of the prior art.

SUMMARY OF THE INVENTION

The present invention overcomes the shortcomings of the prior art by providing a coal water slurry atomizer utilizing supersonic gas velocities. The present invention has many advantages over other atomizers such as decreased erosion of the nozzle and elimination of high pressure pumps.

The coal water slurry atomizer of the present invention allows for atomization to occur outside the nozzle. With this approach, nozzle erosion is minimized as the coal water slurry velocity within the nozzle itself can be extremely small.

Further, atomizer pressure is essentially atmospheric at the nozzle discharge in the present invention, thereby allowing for coal water slurry pumps which only require enough pressure to overcome delivery line losses. Thus, inexpensive, low pressure metering pumps can be used.

A further advantage of the present invention is that the atomizer utilizes supersonic air velocities to atomize the coal water slurry. By using supersonic velocities, higher shear forces can be obtained while using less atomizing air. In this manner, the atomizer of the present invention requires a lower parasitic power requirement than more traditional approaches.

The present invention is achieved by providing an atomizer comprising a central tube defining a coal water slurry passageway, an annular sleeve surrounding the central tube and defining an annular passageway for the flow of a gas and a converging/diverging section in the annular passageway which causes gas to emerge from the annular sleeve at supersonic velocities.

BRIEF DESCRIPTION OF THE DRAWINGS

FIG. 1(*b*) is a front cross-sectional view of the atomizer shown in FIG. 1(*a*).

DETAILED DESCRIPTION OF PREFERRED EMBODIMENTS

The supersonic coal water slurry atomizer of the present invention can be achieved by providing supersonic gas velocities for atomization of coal water slurry through shearing action.

Figure 1B:
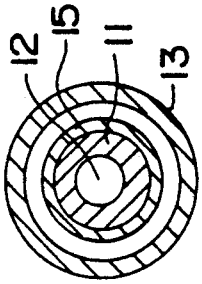
FIG. 1(*a*) is a cross-sectional view of the supersonic coal water slurry atomizer of the present invention.
Figure 1A:
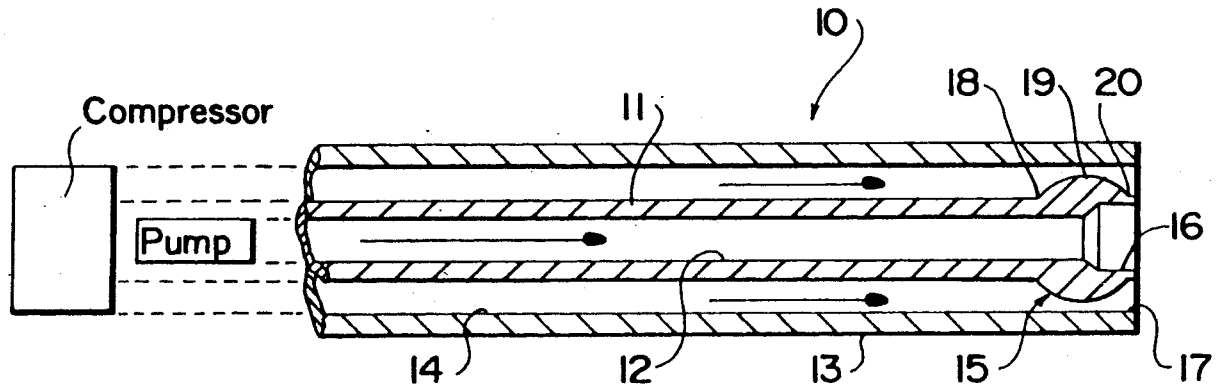

Referring to FIGS. 1(*a*) and 1(*b*), a supersonic coal water slurry atomizer 10 of the invention generally comprises a central tube 11 surrounded by an annular sleeve 13. The central tube 11 defines a coal water slurry passageway 12 for carrying coal water slurry. An outlet or exit 16 is provided at one end of the coal water slurry passageway 12. This outlet may be machined to decrease the wall thickness of the central tube 11 at the tip. The annular sleeve 13 surrounding the central tube 11 defines an annular passageway 14 for a secondary fluid. An outlet or exit 17 is provided at one end of the annular passageway 14. A pump is provided at one end of the atomizer 10 for pumping the coal water slurry through the coal water slurry passageway 12, and a compressor is provided for supplying the secondary fluid through the annular passageway 14. The secondary fluid flowing in the annular passageway 14 may be any compressible fluid such as air or steam. Of course, other fluids may be utilized provided that proper atomization of the coal water slurry is achieved.

The annular passageway contains a converging-/diverging section 15 which causes the secondary fluid passing through the annular passageway 14 to converge and then to diverge from the exit 17 at an accelerated velocity. The converging/diverging section 15 is constructed so as to cause the secondary fluid which is passing through the annular passageway to accelerate to supersonic velocities. In particular, the converging-/diverging section 15 comprises a converging portion (nozzle entrance) 18, a nozzle throat 19, and a diverging portion (nozzle exit) 20.

For achieving good atomization, it is necessary to maintain a high momentum flux of secondary fluid (gas) relative to the coal water slurry. The momentum flux is defined as the product of the shearing fluid density, and the square of the velocity. Typically, twin fluid atomizers operate at sonic conditions at the nozzle discharge. Therefore, in order to increase the momentum flux, the density and therefore the pressure must be increased. By allowing the secondary fluid to operate at supersonic conditions, the same degree of atomization can be obtained at lower flow rates of the shearing fluid (coal water slurry) or a higher degree of atomization can be obtained from the same flow rate than would exist at sonic conditions.

The design approach for the supersonic airstream of the present invention is based on a one dimensional analysis derived by A. H. Shapiro (The Dynamics and Thermodynamics of Compressible Fluid Flow, Wiley Inc., 1953). From the energy equation, in the absence of heat transfer, the stagnation temperature throughout the nozzle is constant.

$$\text{Energy Equation: } h_o = h_1 + \frac{V_1^2}{2} = h_o + \frac{V_2^2}{2} = \text{Constant}$$

$$\text{Stagnation Temperature: } T_o = T + \frac{V^2}{2\,c_p},$$

where $c_p$ is specific heat at constant pressure.

The static temperature which is needed to determine the local speed of sound can be found for an ideal gas by:

$$\frac{T_o}{T} = 1 + \frac{k-1}{2} M^2 \tag{1}$$

where M is the Mach number, $T_o$ is the stagnation temperature, T is the static temperature of the gas stream, and k is the specific heat ratio. If it is assumed that the flow of secondary fluid is isentropic through the nozzle, the static conditions at the nozzle discharge can be related with the stagnation conditions at the nozzle entrance via the relations:

$$\frac{p_o}{p} = \left(1 + \frac{k-1}{2} M^2\right)^{\frac{k}{k-1}} \tag{2}$$

$$\frac{\rho_o}{\rho} = \left(1 + \frac{k-1}{2} M^2\right)^{\frac{1}{k-1}} \tag{3}$$

By using equation (2) and specifying the nozzle operation pressure $p_o$, and the discharge pressure p as atmospheric, the design point Mach number can be found. For example, a design point pressure can be chosen as 50 psig for this analysis although manufacturing tolerances may cause an actual design point pressure of 47.2 psig. This translates to a design point Mach number of 1.593. By using the continuity equation for compressible flow:

$$\frac{A}{A^*} = \frac{w/A^*}{w/A} = \frac{1}{M}\left[\left(\frac{2}{k+1}\right)\left(1 + \frac{k-1}{2} M^2\right)\right]^{\frac{k+1}{2(k-1)}} \tag{4}$$

wherein A is the nozzle exit area, A* is the nozzle throat area and w is mass flow rate. The area ratio of the nozzle exit to the nozzle throat is found to be 1.2449 for this particular value of the Mach number. By using the continuity equation again, the area of the nozzle throat and exit can be found to pass the required mass flow rate of air.

In order to determine the mass flow rate of air that is needed for proper atomization, reliance can be made on data that for every pound of coal water slurry that is atomized, between 1.5 and 3 lbs. of compressed air is needed. Since the supersonic design requires this amount or less, the design mass flow is fixed once the input rate for a furnace is chosen.

The design point conditions fix the nozzle operating pressure. However, at off design point conditions, it is important to know how the relative shear between the supersonic airstream and the coal water slurry changes. Design point conditions and off design point conditions are meant to refer to the point for given upstream conditions where supersonic, shock free conditions exist, and nozzle pressure is equal to the applied back pressure. As long as the nozzle pressure is high enough and a normal shock is not present in the diverging section of the nozzle, the Mach number at the exit of the diverging section of the nozzle will remain constant at 1.593. If the nozzle inlet temperature does not change, then the velocity at the nozzle exit plane is constant regardless of nozzle operating pressure.

A shock is a discontinuity in a (partly) supersonic fluid flow. Fluid crossing a stationary shock front rises suddenly and irreversibly in pressure and decreases in velocity.

At pressures above design point, the nozzle exit velocity is the same as the design point. For this case, the nozzle discharge pressure adjusts to atmospheric pressure outside the nozzle in the form of oblique expansion waves which cannot be described by one dimensional analysis. At pressures below the design point, but high enough to ensure that a normal shock is not present in the nozzle, the nozzle exit velocity is the same as the design point condition. For this case, the nozzle discharge pressure adjusts to atmospheric pressure in the form of oblique compression waves outside the nozzle, which again cannot be described by one dimensional analysis.

In order to determine the minimum pressure required to have shock free conditions within the nozzle, the normal shock relation for the static pressure ratio before and after the shock is used:

$$\frac{p_y}{p_z} = \frac{2k}{k+1} M_x^2 - \frac{k-1}{k+2} \quad (5)$$

For this analysis, the shock is assumed to be just at the exit of the diverging section of the nozzle where the Mach number is 1.593 and the downstream static pressure is atmospheric. Solving for the static pressure upstream of the shock and using the isentropic relations, the nozzle stagnation pressure can be found. Using these relations, it is found that the minimum pressure needed for shock free operation within the nozzle itself is 7.5 psig. Since for all practical cases, the nozzle is operated at a higher pressure than this, there are no normal shocks present, and adjustment to atmospheric pressure occurs outside the nozzle.

Figure 2:
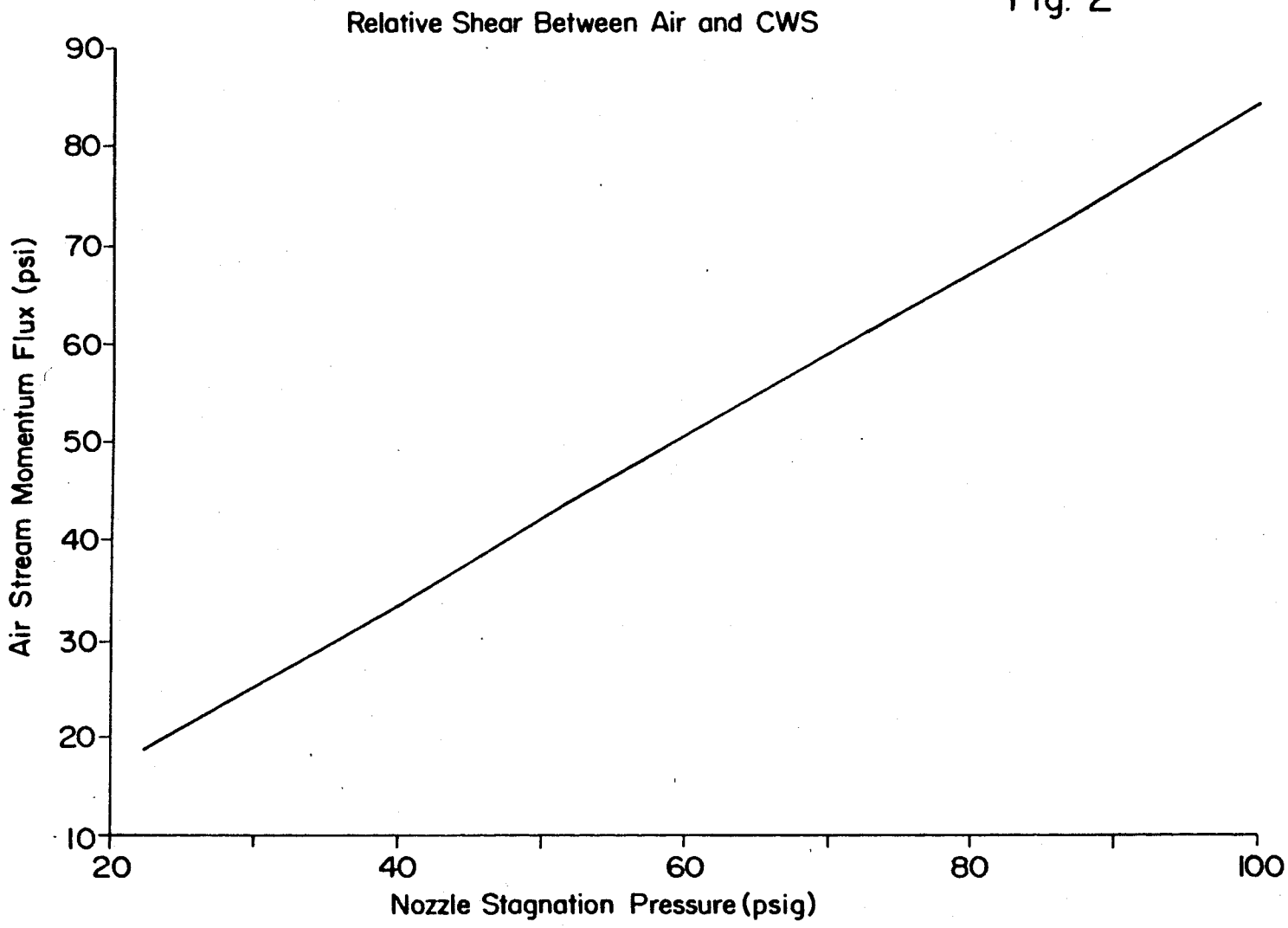
FIG. 2 is a graph showing the relative shear between air and coal water slurry.

The momentum flux of the airstream, which is defined as the product of the static density at the nozzle exit plane and the air velocity squared, establishes the relative shear between the air and the coal water slurry for atomization. To understand how the momentum flux changes at off design condition, the momentum flux is plotted as a function of the nozzle stagnation pressure as shown in FIG. 2. This shows that the momentum varies linearly with pressure which is due to the fact that under the pressure range of operation, the velocity at the nozzle exit plane is constant, and the density varies linearly with stagnation pressure.

Figure 3:
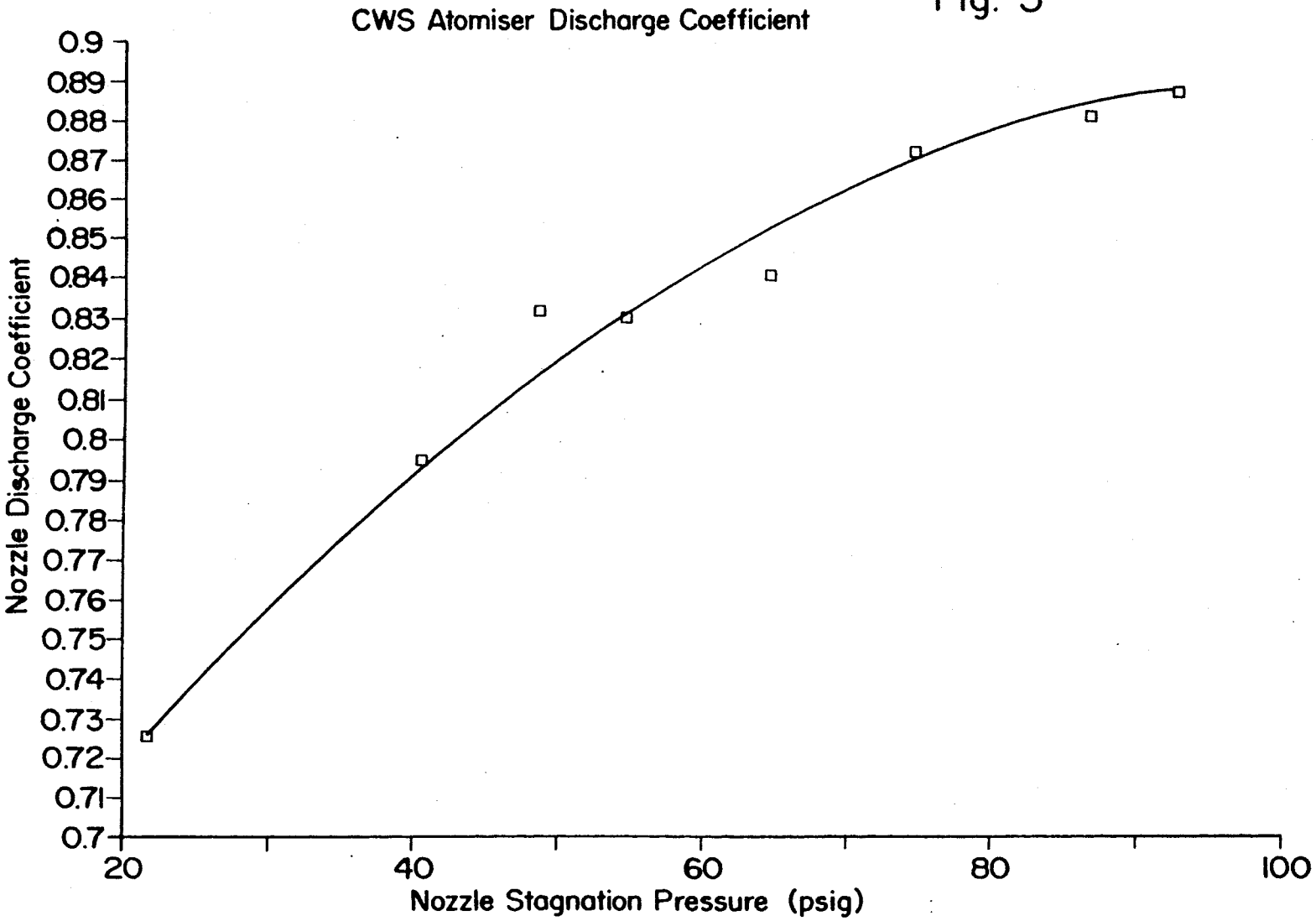
FIG. 3 is a graph showing coal water slurry atomizer discharge coefficient.

The underlying assumption in the design of the coal water slurry atomizer is that the flow behaves essentially one dimensionally and is isentropic. Deviations from these assumptions can best be seen through the discharge coefficient. The discharge coefficient is defined as the actual mass flow rate the nozzle passes compared to the maximum possible that the nozzle could pas, based on isentropic flow. The discharge coefficient for this nozzle is plotted as a function of pressure as shown in FIG. 3, where it can be seen that the discharge coefficient varies from about 72% at low pressure to about 85% of the theoretical maximum possible flow rate at the design condition, and approaching 90% for high pressure operation.

From the above analysis, the dimensions of the supersonic coal water slurry atomizer may be obtained. In particular, based on nozzles tested to date, the diameter of the central coal water slurry passage 12 may range from about 0.125 in. to about 0.260 in.

A specific example of dimensions of the annular passageway 14 may be about 0.375 in. (outer diameter) and 0.250 in. (inner diameter) while the dimensions of the annular passageway 14 at the nozzle exit may be about 0.375 in. (outer diameter) and about 0.360 in. (inner diameter).

The converging/diverging section 15 may be positioned at a distance from about 0.06 in. to about 0.25 in. from the end of the nozzle. Preferably, the converging-/diverging section is located about 0.06 in. from the end of the nozzle.

Typical flow rates for the coal water slurry may range from about 5 lb/hr to about 25 lb/hr with a velocity of about 0.22 to about 1.11 ft/s. To achieve this flow rate, pumps such as peristaltic pumps can be used.

The flow rate of secondary fluid flowing through the annular passageway 14 may range from about 10 lbm/hr to about 30 lbm/hr. The velocity of the secondary fluid at the exit of the nozzle may be about 1,150 to about 2,800 ft/s. The velocity of the secondary fluid travelling through the annular passageway prior to reaching the converging/diverging portion can be about 25 ft/s, which advantageously prevents frictional pressure losses in the atomizer. Compressors which may be used for pumping the secondary fluid include small piston compressors.

The overall length of the atomizer may preferably be about 5.5 in. with an outside diameter of about 0.5 in. Atomization of the coal water slurry occurs external to the nozzle due to shearing action. The use of fluid traveling at supersonic velocities emerging from the converging-diverging section 15 allows for minimal air flow rates for a given coal water slurry flow rate.

The materials utilized for the atomizer 10 of the present invention may be any material suitable for coal water slurry applications. For example, a suitable material may be stainless steel. Further, the components of the atomizer may be machined by any known machining methods to achieve the desired dimensions.

While the present invention has been described with reference to particular preferred embodiments, the invention is not limited to the specific examples given, and other embodiments and modifications can be made by those skilled in the art without departing from the spirit and scope of the invention.

What is claimed is:

1. An apparatus for atomizing a substantially liquid fluid through shearing action external to the device, between said substantially liquid fluid and a secondary fluid, said apparatus comprising:

a central tube;

means for causing a substantially liquid fluid to flow through said central tube and to emerge from said central tube at a first outlet opening;

an annular sleeve disposed around said central tube having a common axis with said central tube, and defining an annular passageway for the flow of a secondary fluid;

means for causing said secondary fluid to enter said annular passageway below supersonic velocity, and for causing said secondary fluid to flow through said annular passageway and to emerge from said passageway at essentially atmospheric pressure through a second outlet opening concentric with said first outlet opening and in the same plane normal to the axis of said tube and said sleeve; and a converging section followed by a throat and then by a diverging section in said annular passageway causing said secondary fluid to emerge through said second outlet opening at a supersonic velocity.

2. The atomizer of claim 1, wherein said diverging section and said throat have an area ratio of about 1.00 to about 2.64.

3. The atomizer of claim 1, wherein said diverging section and said throat have an area ratio of about 1.25.

4. The atomizer of claim 1, wherein said means for causing said secondary fluid to flow through said annular passageway is a compressor.

5. The atomizer of claim 1, wherein said means for causing said liquid fuel to flow through said central tube is a pump.

6. The atomizer of claim 5, wherein said pump causes said liquid fuel to flow through said central tube at a velocity of about 0.22 to about 1.11 ft/s.

7. The atomizer of claim 1, wherein said velocity of said secondary fluid at said second outlet ranges from about 1,150 to about 2,800 ft/s.

8. The atomizer of claim 1, wherein said liquid fuel is a coal water slurry.

9. The atomizer of claim 1, wherein said secondary fluid is a gas.

10. The atomizer of claim 1, wherein said liquid fuel is a coal, water slurry and said secondary fluid is a gas.

11. A method of atomizing a liquid fluid, comprising:

flowing a substantially liquid fluid at a first velocity through a first passageway having a first outlet;

flowing a secondary fluid at a second velocity below a supersonic velocity through an annular second passageway surrounding said first passageway, said second passageway having a common axis with said first passageway and a second outlet concentric with said first outlet and in the same plane normal to the axis of said passageways, said second velocity increasing to a supersonic velocity at said second outlet; and maintaining said secondary fluid at essentially atmospheric pressure as it emerges from said second outlet, whereby said substantially liquid fluid is atomized through shearing action between said substantially liquid fluid and said secondary fluid external to the nozzle.

12. The method of claim 11, wherein said secondary fluid is a gas.

13. The method of claim 11, wherein said substantially liquid fluid is a coal water slurry.

14. The method of claim 11, wherein said substantially liquid fluid is a coal water slurry, and said secondary fluid is a gas.

15. The method of claim 11, wherein said first velocity ranges from about 0.22 to about 1.11 ft/s.

16. The method of claim 11, wherein said second velocity ranges from about 1,150 to 2,800 ft/s through said second outlet.

17. The method of claim 11, further comprising the step of converging and diverging said secondary fluid in said second passageway so that said secondary fluid reaches said supersonic velocity at said second outlet.

* * * * *